US005471769A

United States Patent [19]

Sink

[11] Patent Number: 5,471,769

[45] Date of Patent: Dec. 5, 1995

[54] SHOE LACING SYSTEM WITH HOOK AND EYE PORTIONS

[75] Inventor: Jeffrey A. Sink, Redwood City, Calif.

[73] Assignee: K-Swiss Inc., a Delaware Corporation, Chatsworth, Calif.

[21] Appl. No.: 65,356

[22] Filed: May 19, 1993

[51] Int. Cl.[6] ..... A43B 11/00

[52] U.S. Cl. ..... 36/50.1; 36/58.5; 24/712.1

[58] Field of Search ..... 36/50.1, 58.5, 36/97, 114, 136, 138; 24/712.1, 712.5, 713.6, 714.6, 715.1, 712.9, 713.3, 713.4

[56] References Cited

U.S. PATENT DOCUMENTS

| | | | |
|---|---|---|---|
| 145,776 | 12/1873 | Babbitt | 36/50.1 |
| 171,301 | 12/1875 | McKee | 36/50.1 |
| 864,774 | 9/1907 | Dumke | 24/715.1 |
| 2,925,672 | 2/1960 | Trovato | 36/50.1 |
| 3,703,775 | 11/1972 | Gatti | 36/50.1 |
| 4,245,408 | 1/1981 | Larsen et al. | 36/58.5 |
| 5,158,428 | 10/1992 | Gessner et al. | 24/712.1 |

FOREIGN PATENT DOCUMENTS

| | | | |
|---|---|---|---|
| 0199766 | 11/1938 | Switzerland | 24/712.1 |
| 0328267 | 4/1930 | United Kingdom | 36/50.1 |

*Primary Examiner*—Thomas P. Hilliard
*Attorney, Agent, or Firm*—Drucker & Sommers

[57] ABSTRACT

The invention is a single hand operation shoe lacing system which has an elongate lace strap which is affixed at its front end to a lacing area of the shoe in the vicinity of the vamp. The lace strap is looped through a series of lace strap loops positioned in the lacing area of the shoe, alternately on the medial and lateral quarter panels of the shoe. The rear end of the lace strap adjustably carries a first engagement member with a second engagement member being positioned on the counter of the shoe. The first engagement member is adjustably positionable on the lace strap to adjust its working length. When the first engagement member is engaged with the second engagement member, the lace strap will draw the medial and lateral sides of the quarter together, and thereby fit the shoe to the wearer's foot, and when the first and second engagement members are disengaged, the medial and lateral quarter panels of the shoe can be separated, and thereby loosen the shoe on the wearer's foot. The shoe lacing system of the invention can easily be engaged and disengaged by a single hand operation.

14 Claims, 2 Drawing Sheets

SHOE LACING SYSTEM WITH HOOK AND EYE PORTIONS

BACKGROUND OF THE INVENTION

1. Field of the Invention

The invention relates to shoe lacing or strapping system, particularly a shoe lacing system employing a lace or strap with an improved fastener means.

2. Description of the Prior Art

Shoe lacing systems have traditionally consisted of a single detachable shoe lace which is laced in shoe such that the mid-part of the length of a shoe lace is laced through eyelets or hooks near the front toe area (vamp) of the shoe. The two free and working ends of the shoe lace are passed through a series of eyelets located along the longitudinal line of the lacing area of the shoe, and are normally tied in a bow knot to draw the lacing area of the shoe together, and thereby fit the shoe to the wearer's foot.

While traditional lacing systems have served the general wearer well, there are inherent problems with this conventional system. First, two hands and manual dexterity are required to adjust and tie the laces, making the conventional lacing system difficult to use for the very young, those with dexterity problems, or those who have only one available hand. Also, since the conventional shoe laces criss-cross, the criss-crossed laces sometimes tend to bind up with each other, and manual adjustment of the lace tension between pairs of opposite eyelets positioned on the lacing area may be necessary. Bow knots can frequently come undone.

There have attempts to overcome the shortcomings of the conventional shoe lace systems. U.S. Pat. Nos. 864,774 to Dumke, 5,016,327 to Klausner and, 3,683,520 to Partagas disclose various lacing systems for boots and high ankle shoes wherein a flat elongate lacing strap or round lace is arranged with one end immobilized near the vamp area of the shoe, leaving a single free working end to be laced through the other eyelets, and then engaged at the upper ankle portion of the boot or high ankle shoe.

In the Dumke lace system, the lower end of the strap near the vamp is permanently fixed thereto, and the single free, working end of the lacing strap has one or more slits which are adapted to engage with one or more buttons provided on the upper extremity of the ankle portion of the boot. Alternatively, a single slit, formed in the end of the strap, with an interposed adjustment clasp and loop, can be used to adjust the tension of the strap when the slit is engaged with a single button on the upper extremity of the ankle portion of the boot. The formation of slit(s) in the lacing strap is a point of weakness in the lacing system.

In the Klausner system, the lower end of the lace strap is detachably fixed at the vamp of the boot, and its free, working end has hook and loop material attached thereto for engagement with complementary hook and loop material positioned on the upper region of the ankle portion of the boot.

Partagas discloses a safety shoe lace system for baby boots, wherein the shoe lace is permanently fixed at either its lower end to the vamp of the shoe, or at its upper end, to the uppermost eyelet of the lacing area, and has a relatively enlarged spherical member affixed to its free, working end, to prevent it from being drawn through the eyelets. The free, working end will in turn be engaged with a securing hook, located at the vamp, or at the upper region of the ankle portion of the boot to adjust the shoe to the wearer's foot.

Despite considerable efforts, the prior attempts at creating a shoe lacing system for single hand closure and having a single, reliable and precise adjustment means have not been totally successful, and, in fact, have drawbacks of their own. For example, in Dumke, the lace adjustment means inherently requires a weakening of the straps; the multiple hook and eye engagement means of the Klausner lacing system are readily separable—i.e., do not provide a positive locking means. Similarly, the Partagas locking structure, while perhaps sufficient for the purpose of a baby boot, does not offer a sufficient positive lock against greater tension exerted by children and adults.

Also, in the Partagas system, the problem of taking up the slack of the shoe lace and engaging the free working end of the lace is solved by providing a securing hook, around which the lace can be wrapped many times, and thereby secured. Such a securing hook, it is noted, would preferably be provided with a cover. However, this arrangement would be wholly inapplicable for use with a lace strap.

Accordingly, there remains a need for a simple and economical shoe lacing system that (1) is readily and precisely adjustable by an adjustment means, (2) has a first locking means to positively lock the adjustment means in the precisely adjusted position of the lacing strap, and (3) has a second locking means for positive locking of the adjusted lacing strap.

The applicant is aware of buckles, in general, having an adjustment means combined with a hook and eye locking member (e.g., see Guenther U.S. Pat. No. 1,718,291) but is not aware of a locking and adjustment means for a shoe lacing system as is here in described and claimed.

SUMMARY OF THE INVENTION

The lacing system of this invention preferably uses a lacing strap or web as the lace or lacing means. The lace is secured to a lower end of a conventional lacing area located in the quarter area of the shoe. The lacing strap is then threaded through staggered lacing rings located in the lacing area in a zigzag fashion.

The upper end of the lacing strap has attached thereto a lace strap adjustment means preferably integrally combined with a positive locking means. The length of the lace strap is precisely adjustable by the lace strap adjustment means, and lockable in the adjusted position by a first locking means. Once the lacing strap length has been adjusted and securely locked by the first positive locking means, a second positive locking means, comprising preferably a hook member affixed to the lacing strap, is engaged with a complementary eye member mounted to the counter of the shoe. The eye member is preferably spaced a substantial distance from the lacing area so that the fastening point of the hook member lies approximately 3" to 5" away from the lacing area. Any slack taken up during the adjustment of the lacing strap is folded under the lace strap adjustment means in the 3" to 5" distance between the lacing area and the fastening point. In this way, any slack is neatly hidden away from view while being readily accessible if further adjustment of the lacing strap becomes necessary. The second positive locking means may be engaged and disengaged by the single hand of a user.

The lacing system thus comprises a double locking system, a first one for the adjustment of the lacing strap, and a second one for the fastening of the (adjusted) lacing strap itself. Such a double locking system will be found especially advantageous for sport shoes, hiking shoes, etc. where the wearer's foot encounters large forces.

BRIEF DESCRIPTION OF THE DRAWINGS

The invention is described below in greater detail with reference to the drawings.

DESCRIPTION OF THE PREFERRED EMBODIMENT

Figure 1:
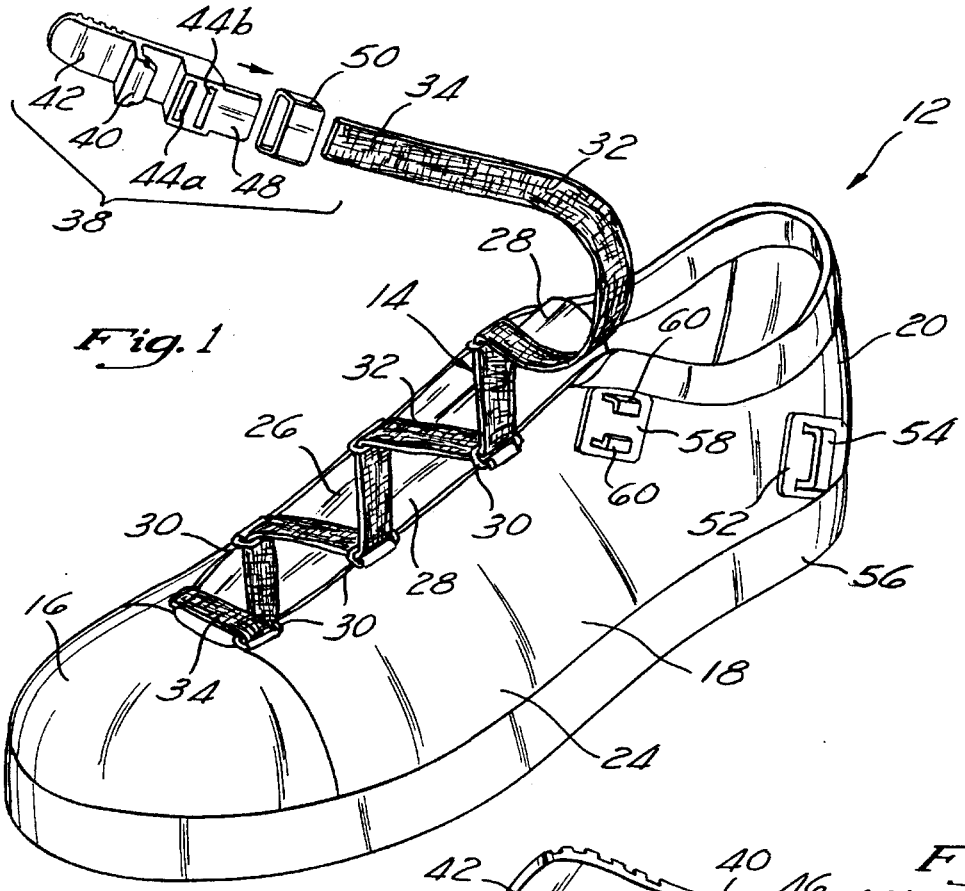
FIG. 1 is a perspective view of a shoe with the same lacing system of the invention.
Figure 2:
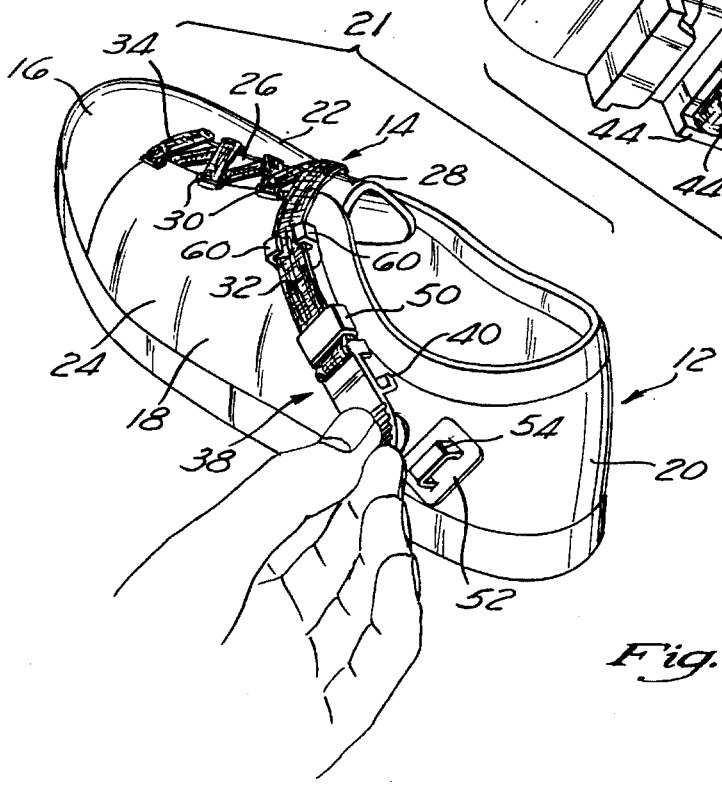
FIG. 2 is a second perspective view of the shoe lacing system.
Figure 4:
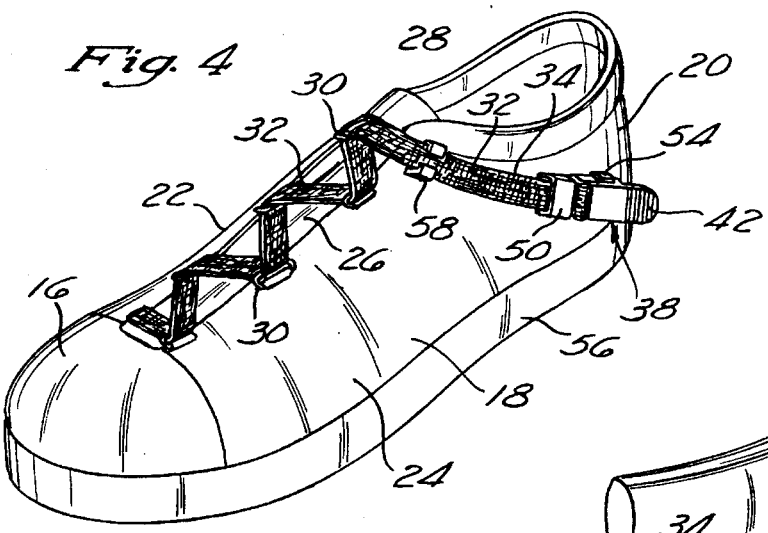
FIG. 4 is a perspective view of a shoe with its shoe lacing system engaged.

Referring first to FIGS. 1 and 2, a shoe 12 with a single hand operation shoe lace system 14 of the invention is shown. The shoe has a vamp (toe) area 16, a quarter area 18, which roughly corresponds with the mid-portion of the shoe 12, and a counter area 20, in which the heel of the wearer's foot is cradled.

The quarter area 18 has a medial quarter panel 22 and a lateral quarter panel 24, and a lacing area 26 roughly defined by the area between the two quarter panels 22 and 24, under which a shoe tongue 28 passes. The vamp area 16, quarter area 18, and counter area 20, are generally designated as the upper 21 of the shoe. A series of lace strap loops 30 are positioned on the medial and lateral quarter panels 22 and 24 in the vicinity of the perimeter of the lacing area 26 of the shoe. These lace strap loops 30 are preferably oriented in a zig-zag orientation in the lacing area 26 of the shoe 12, but can be positioned directly across each other in the lacing area 26.

Figure 3:
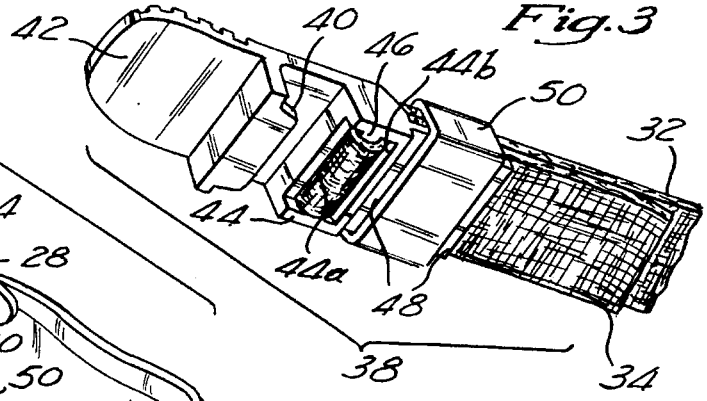
FIG. 3 is a perspective view of the first engagement member carried on the lace strap.
Figure 5:
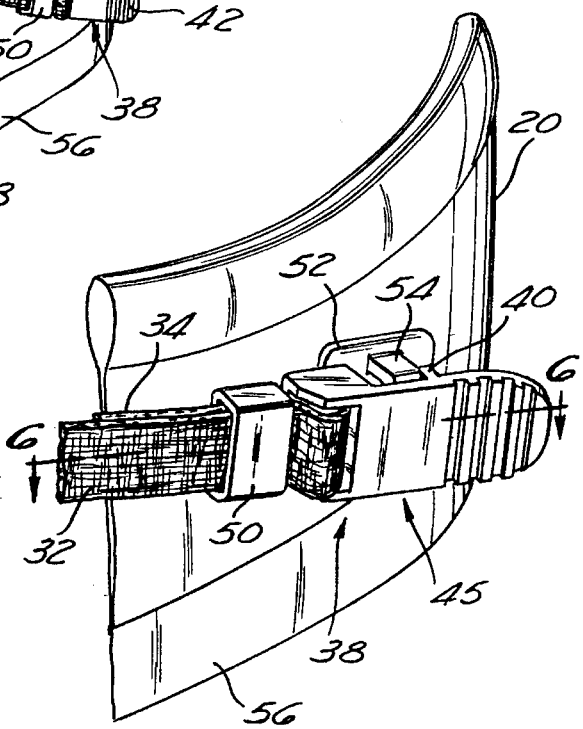
FIG. 5 is a detail of FIG. 4 showing the engagement of the first and second engagement members.
Figure 6:
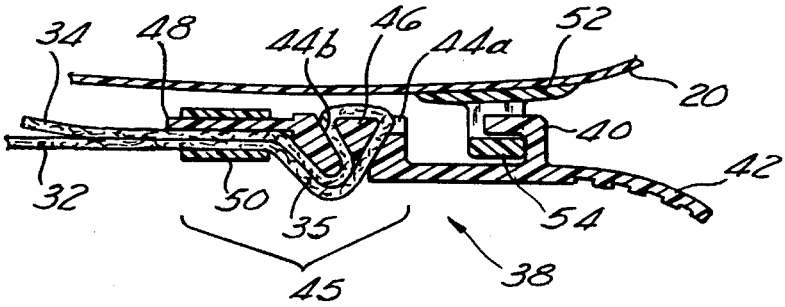
FIG. 6 is a cross-sectional view of the engaged first and second engagement members taken along lines 6—6 of FIG. 5.

An elongate lace strap 32 is looped in a zig-zag manner through the lace strap loops 30. The lace strap loops 30 are sized to allow the lace strap 32 to slide therethrough in a relatively low friction manner. The lace strap loops 30 are preferably elongate and have generally straight sides which generally correspond to the width of the lace strap 32. The lace strap loops 30 can be constructed of metal, plastic, or other materials. The vamp or forward end 34 of the elongate lace strap is attached to the frontal lacing area 26 of the vamp 16. The elongate lacing strap 32 can be detachably attached near the vamp 16, or, alternately can be permanently attached thereto, as by stitching to the vamp. As best shown in FIGS. 3, 5, and 6, the rearward portion of the elongate lace strap 32 carries a preferably unitary lace adjustment and locking member 38 preferably made of plastic or metal. The unitary lace strap adjustment and locking member 38 includes:

a) a strap loop portion 45 comprising a triangular looping bar 46 around which the lace strap member 32 is wrapped and locked. More specifically, the leading end portion, or "lace leader" 35 of the lace strap member 32 is fed through sleeve 50, passes through slots **44*a* and 44*b* and is thereby wrapped around triangular looping bar 46. Lace leader 35 is then pulled over a flat extension plate 48 extending beyond slot 44*b* and through sleeve 50, for a desired distance, as best seen in FIG. 6. When the desired distance is achieved, the lace strap 32 is thereby locked in place and will not inadvertently retract, i.e. become loosened. This is because the edges of the bar 46 grip the lace strap 32, and prevent its retraction. The compression sleeve 50** also aids in securing the lace strap in the adjusted position, but is not absolutely necessary.

The herein described adjustment and locking of the lace strap 32 in the adjusted position is superior to strap adjustment means having "saw-teeth" or serrated edges bordering a slot to prevent retraction of a strap, or the like, in that while positive locking does occur in this latter construction, the strap itself becomes rapidly worn, frayed, and unsightly.

b) The unitary lace strap adjustment and locking member 38 also includes an integrally formed hook member 40 and an adjacent pull tab 42.

After the desired adjustment and locking of the length of the lace strap 32 has been made, the hook member 40 is engaged with a complementary eye member 52, and positively locks the lace strap 32 to the shoe. The complementary eye member 52 is provided with a loop 54 sized to engage with the hook portion 40 of the adjustment and locking member 38. The eye member 52 is permanently affixed to the counter 20 of the shoe 12, preferably no higher then midway between its upper edge and the mid-sole 56 of the shoe, and more preferably lower—close to the mid-sole 56.

To obtain another desired adjusted locked position of lace 32, the hook member 40 is disengaged from eye member 52, the compression sleeve 50 is slid off the plate extension 48—so as to loosen the leader portion 34 with respect to the unitary lace strap adjustment and locking member 38, and thereby render it freely and manually adjustable therewith. After the leader portion 34 has been re-adjusted, the compression sleeve 50 is then replaced, as before, to help positively lock the lace strap 32 in the readjusted position.

A lace strap guide 58 is positioned on the rearmost area of the lacing area 26, or rearwardly thereof, and has a pair of guide walls 60 spaced apart to slideably receive the lace strap 32 therebetween. The strap guide 58 is oriented such that the lace strap 32 is directed towards the eye member 52.

In initiating the wearing of the shoe lacing system of this invention, the lace 32 is first attached to the adjustment and locking member 38, as above described. A rough adjustment of the desired tension is made so that the hook member 40 is approximately aligned with the eye member 54, and is engaged therewith. Then, the final adjustment and locking of the lace member 32 takes place by loosening the compression sleeve 50, and then manually lengthening or shortening the lace leader 34, and the locking the lace 32. The final desired position of the lace 32 is retained even when the shoe is removed, by merely unhooking hook member 40 from eye member 54.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the following claims:

I claim:

1. A shoe lacing system for use with a shoe comprising; an upper, having a vamp, a quarter with medial and lateral quarter panels, a lacing area generally located between said medial and lateral quarter panels; a counter; and a sole connected to the upper, the shoe lacing system comprising:

an elongate lace strap;

a plurality of lace straps loop means positioned on the medial and lateral panels in the vicinity of the lacing area, wherein said elongate lace strap is affixed at a first end in the vicinity of the vamp, and wherein said lace strap is alternately looped through said series of lace strap loop means on the medial and lateral quarter panels, said elongate lace strap having an excess length extending out of the lacing area with a second, free, working end;

a first engagement means which is adjustably positionable on the second, free, working end of said elongate strap, said first engagement means including a hook portion, a pull tab extending forwardly of said hook portion, a hookless looping bar positioned rearwardly of said hook portion, around which said elongate lace strap is looped, with that portion of said elongate lace strap which extends beyond the looping bar being folded under a generally flat plate portion extending rearwardly of said looping bar, and a retainer sleeve member, which is slidably carried on said elongate lace strap, and which when slid onto said plate portion and onto the folded under elongate lace strap assists in securing said lace strap in its desired position; and a second engagement means having an eye portion, which is detachably engageable with said hook portion of said first engagement means, said second engagement means being spacedly positioned a substantial distance from said lacing area and on the counter of said shoe, wherein said excess length of lace strap is positioned between said lacing area and said second engagement means.

2. The shoe lacing system of claim 1, wherein said shoe lace system further comprises a lace strap guide positioned on the upper of the shoe to guide said elongate lace strap to said second engagement means, said lace strap guide having a pair of guide walls, spaced apart to slideably receive said lace strap therebetween.

3. The shoe lacing system of claim 1, wherein each of said lace strap loop means have a slot formed therethrough, said slot sized to slideably receive said elongate lace strap, said lace strap loops being positioned on upper edges of said medial and lateral quarter panels and extending into said lacing area.

4. The shoe lacing system of claim 1, wherein said first end of said elongate lace strap is permanently affixed to one of the medial and lateral quarter panels, in the vicinity of the vamp.

5. The shoe lacing system of claim 1, wherein said second engagement means is positioned on one of the medial and lateral sides of the counter, near the sole of the shoe and rearward of said lacing area.

6. A shoe lacing system with improved fastener means for use with a shoe comprising; an upper having a vamp, a quarter with medial and lateral quarter panels, a lacing area generally located between said medial and lateral quarter panels, a counter; and a sole connected to the upper; the shoe lacing system comprising:

a single lace member attached at a first end in the vicinity of the vamp of the shoe, said single lace member having an excess length;

a first adjustment and locking means for adjusting the effective length of said lace member at its second, working end and for locking said lace member in the adjusted position, comprising a hookless looping bar around which said excess length of said lace member is looped and folded under adjacent portions of said lace member, a plate portion located rearwardly of said looping bar, and a retainer sleeve member, which is slidably carried on said lace member, and which secures the excess length of the folded over lace member to the adjacent portions of said lace member and to the place portion over which the sleeve slides; and a second positive locking means for locking the lace member in its locked adjusted position to the shoe, comprising a first shoe engagement means affixed to the end of said lace member, including one of a hook portion and an eye portion, and a second engaging means, affixed to the counter of said shoe at an area spaced from said lacing area, wherein any excess length of lace member lies between said lacing area and a line of engagement of said first and second engagement means, and is folded under adjacent portions of said lace member, said second engagement means including one of an eye portion and a hook portion, engageable with said first shoe engagement means.

7. The shoe lacing system of claim 6, wherein said first engagement means further comprises a hook portion, and said second engagement means further comprises an eye portion sized to detachably engage with said hook portion of said first engagement means.

8. The shoe lacing system of claim 7, wherein said first engagement means further comprises a pull tab extending forwardly of said hook portion.

9. The shoe lacing system of claim 6, wherein said shoe lace system further comprises a lace strap guide positioned on the upper of the shoe to guide said lace member to said second engagement means, said lace strap guide having a pair of guide walls, spaced apart to slideably receive a lace means therebetween.

10. A shoe lacing system for use with a shoe comprising; an upper, having a vamp, a quarter with medial and lateral quarter panels, a lacing area generally located between said medial and lateral quarter panels; a counter; and a sole connected to the upper, the shoe lacing system comprising:

an elongate lace strap;

a plurality of lace straps loop means positioned on the medial and lateral panels in the vicinity of the lacing area, wherein said elongate lace strap is affixed at a first end in the vicinity of the vamp, and wherein said lace strap is alternately looped through said series of lace strap loop means on the medial and lateral quarter panels, said elongate lace strap having an excess length extending out of the lacing area with a second, free, working end;

a first engagement means which is adjustably positionable on the second, free, working end of said elongate strap, said first engagement means including a hook portion, a pull tab extending forwardly of said hook portion, a hookless looping bar positioned rearwardly of said hook portion, around which said elongate lace strap is looped, with that portion of said elongate lace strap extending beyond the looping bar being folded under a generally flat plate portion extending rearwardly of said looping bar, and a retainer sleeve member which is slideably carried on said elongate lace strap, and which when slid onto said plate portion and onto the folded under elongate lace strap assists in securing said lace strap in its desired position; and a second engagement means having an eye portion, which is detachably engageable with said hook portion of said first engagement means, said second engagement means being spacedly positioned a substantial distance from said lacing area and on the counter of said shoe, wherein said excess length of lace strap is positioned between said lacing area and said second engagement means.

11. The shoe lacing system of claim 10, wherein said shoe lace system further comprises a lace strap guide positioned on the upper of the shoe to guide said elongate lace strap to said second engagement means, said lace strap guide having a pair of guide walls, spaced apart to slideably receive said lace strap therebetween.

12. The shoe lacing system of claim 10, wherein each of said lace strap loop means have a slot formed therethrough, said slot sized to slideably receive said elongate lace strap, said lace strap loops being positioned on upper edges of said medial and lateral quarter panels and extending into said lacing area.

13. The shoe lacing system of claim 10, wherein said first end of said elongate lace strap is permanently affixed to one of the medial and lateral quarter panels, in the vicinity of the vamp.

14. The shoe lacing system of claim 10, wherein said second engagement member is positioned on one of the medial and lateral sides of the counter, near the sole of the shoe and rearward of said lacing area.

* * * * *